US011986079B2

(12) United States Patent
Lee

(10) Patent No.: US 11,986,079 B2
(45) Date of Patent: May 21, 2024

(54) LIPSTICK CASE

(71) Applicant: SAMHWA Co., LTD., Uiwang-si Gyeonggi-do (KR)

(72) Inventor: Kyung Chang Lee, Uiwang-si Gyeonggi-do (KR)

(73) Assignee: SAMHWA CO., LTD., Uiwang-si (KR)

( * ) Notice: Subject to any disclaimer, the term of this patent is extended or adjusted under 35 U.S.C. 154(b) by 895 days.

(21) Appl. No.: 16/980,203

(22) PCT Filed: Mar. 12, 2019

(86) PCT No.: PCT/KR2019/002845
§ 371 (c)(1),
(2) Date: Sep. 11, 2020

(87) PCT Pub. No.: WO2019/177340
PCT Pub. Date: Sep. 19, 2019

(65) Prior Publication Data

US 2021/0007463 A1 Jan. 14, 2021

(30) Foreign Application Priority Data

Mar. 13, 2018 (KR) ..... 10-2018-0028933

(51) Int. Cl.
*A45D 40/06* (2006.01)
*A45D 40/00* (2006.01)

(52) U.S. Cl.
CPC ..... *A45D 40/06* (2013.01); *A45D 2040/0025* (2013.01); *A45D 2200/051* (2013.01)

(58) Field of Classification Search
CPC ..... B65D 83/0027; B65D 83/0033; A45D 2040/208; A45D 2040/0062; A45D 40/20; A45D 40/02; A45D 2200/051; A45D 40/065; A45D 40/06
USPC ..... 206/385; 401/75–78
See application file for complete search history.

(56) References Cited

U.S. PATENT DOCUMENTS 6,773,184 B2 * 8/2004 An ..... A45D 40/24 401/20

FOREIGN PATENT DOCUMENTS

| | | | |
|---|---|---|---|
| KR | 20-0418934 | Y1 | 6/2006 |
| KR | 20-2011-0002813 | U | 3/2011 |
| KR | 20-0475104 | Y1 | 11/2014 |
| KR | 20-0475120 | Y1 | 11/2014 |
| KR | 20-0475887 | Y1 | 1/2015 |
| KR | 10-1640069 | B1 | 7/2016 |
| KR | 10-2016-0108913 | A | 9/2016 |
| KR | 10-2016-0121849 | A | 10/2016 |
| KR | 10-1760637 | B1 | 7/2017 |

* cited by examiner

*Primary Examiner* — Anthony D Stashick
*Assistant Examiner* — Raven Collins
(74) *Attorney, Agent, or Firm* — NKL LAW; Jae Youn Kim

(57) ABSTRACT

A lipstick case is proposed, such that it is advantageous in that not only is outer air prevented from infiltrating into the lipstick case when the lipstick is not used, but any contact between the lipstick and air is also suppressed, thereby preventing degradation of the lipstick.

3 Claims, 9 Drawing Sheets

LIPSTICK CASE

TECHNICAL FIELD

The present invention relates to a lipstick case, and more particularly, to a lipstick case capable of preventing the deterioration of the lipstick by preventing the lipstick from coming into contact with the air as well as preventing external air from flowing into the lipstick case when the lipstick is not used.

BACKGROUND ART

In general, cosmetics used as a tool to make-up the face are used with different functions depending on each face area, and particularly, as a cosmetic used as a tool to make-up the lips, a lipstick or a lip liner may be a representative example.

Such a conventional lipstick case has a stick-shaped lipstick built into a separate case to be used for applying color to the lips, and the lip liner is used to draw the outline of the lips to sharpen the outline of the lips. Lip makeup using such a lipstick and the lip liner is a general trend to use a lipstick and a lip liner of the same color system in parallel, and has been commercialized and sold in various colors according to a user's preference.

On the other hand, when describing the configuration of the lipstick case described above, the lipstick case comprises a main body rotating by a user's hand and a lipstick case that is fastened and fixed to an upper portion of the main body, moves up and down by rotation of the main body, and accommodated with the lipstick.

However, in order to accommodate a solid type lipstick in the lipstick case as above, the lipstick is inserted into the lipstick case using an automated machine. However, when the lipstick case rotatably fastened to the main body is shaken by external shock during carrying, there is a problem in that a part of the solid type lipstick is inserted out of the lipstick case while the lipstick is not accurately positioned in the center of the main body.

PRIOR ART DOCUMENTS (Patent Document 0001) Korean Utility Model Registration No. 475887 (issued on Jan. 5, 2015)

(Patent Document 0002) Korean Utility Model Registration No. 475104 (issued on Oct. 31, 2014)

(Patent Document 0003) Korean Utility Model Registration No. 475120 (issued on Oct. 31, 2014)

(Patent Document 0004) Korean Utility Model Registration No. 418934 (issued on Jun. 8, 2006)

DISCLOSURE

Technical Problem

The present invention is invented to meet the needs of the related art described above, and to provide a lipstick case capable of preventing the deterioration of the lipstick by preventing the lipstick from coming into contact with the air as well as preventing external air from flowing into the lipstick case when the lipstick is not used.

Technical Solution

According to a first embodiment of the present invention, a lipstick case comprises: an upper cover (10) having a cylindrical shape in which an upper portion is closed and a lower portion is opened; a shoulder (20) inserted into a lower opening of the upper cover (10), as a cylindrical member with opened upper and lower portions; a lower cover (30) of which an upper opening is inserted and coupled to a lower outer periphery of a cylindrical protrusion (21) protruding outwards from a center of the shoulder (20), as a cylindrical member with an opened upper portion and a closed lower portion; a rotatable body (40) which is a cylindrical member inserted into the lower cover (30) to rotate integrally with the lower cover (30); a lipstick gripping member (50) which is inserted into an inner center of the rotatable body (40) to ascend and descend while rotating integrally with the rotatable body and grips a lipstick (1) on an upper portion thereof; a guide member (60) which is installed between the rotatable body (40) and the lipstick gripping member (50) and guides to ascend and descend vertically when the lipstick gripping (50) ascends and descends, as a member of which upper and lower portions are opened and an outer periphery is tapered; and a lipstick containing member (70) of which an upper opening is tapered and cut to protect the lipstick (1) therein, as a cylindrical member with opened upper and lower portions fixedly coupled to a tapered outer periphery of the guide member (60), wherein a first air vent member (80) of which a lower portion is opened and a center of an upper surface has a vent hole (81) is installed as a cylindrical member installed between an inner periphery of the upper cover (10) and the outer periphery of the lipstick containing member (70).

According to a second embodiment of the present invention, a lipstick case comprises: an upper cover (10) having a cylindrical shape in which an upper portion is closed and a lower portion is opened; a shoulder (20) inserted into a lower opening of the upper cover (10), as a cylindrical member with opened upper and lower portions; a lower cover (30) of which an upper opening is inserted and coupled to a lower outer periphery of a cylindrical protrusion (21) protruding outwards from a center of the shoulder (20), as a cylindrical member with an opened upper portion and a closed lower portion; a rotatable body (40) which is a cylindrical member inserted into the lower cover (30) to rotate integrally with the lower cover (30); a lipstick gripping member (50) which is inserted into an inner center of the rotatable body (40) to ascend and descend while rotating integrally with the rotatable body and grips a lipstick (1) on an upper portion thereof; a guide member (60) which is installed between the rotatable body (40) and the lipstick gripping member (50) and guides to ascend and descend vertically when the lipstick gripping member (50) ascends and descends, as a member of which upper and lower portions are opened and an outer periphery is tapered; and a lipstick containing member (70) of which an upper opening is tapered and cut to protect the lipstick (1) therein, as a cylindrical member with opened upper and lower portions fixedly coupled to a tapered outer periphery of the guide member (60), wherein a cylindrical second air vent member (90) is installed between the inner periphery of the upper cover (10) and the outer periphery of the lipstick containing member (70) and has an opened lower portion, wherein the second air vent member (90) comprises a cutting surface (91) of which a lower outer periphery is cut and a third circular protrusion (14) is locked to ascend together when the upper cover (10) is opened at the same time of blocking external air while being in contact with the third circular protrusion (14) protruding in a circular strip shape from the inner periphery of the upper cover (10); and a central hole (92) which is formed at the center of an upper surface thereof and inserted into the outer periphery of the second cylinder (15) protruding downwards from the center of the ceiling surface of the upper cover (10) to block air flowing into the lipstick (1).

According to a third embodiment of the present invention, a lipstick case comprises: an upper cover (10) having a cylindrical shape in which an upper portion is closed and a lower portion is opened; a shoulder (20) inserted into a lower opening of the upper cover (10), as a cylindrical member with opened upper and lower portions; a lower cover (30) of which an upper opening is inserted and coupled to a lower outer periphery of a cylindrical protrusion (21) protruding outwards from a center of the shoulder (20), as a cylindrical member with an opened upper portion and a closed lower portion; a rotatable body (40) which is a cylindrical member inserted into the lower cover (30) to rotate integrally with the lower cover (30); a lipstick gripping member (50) which is inserted into an inner center of the rotatable body (40) to ascend and descend while rotating integrally with the rotatable body and grips a lipstick (1) on an upper portion thereof; a guide member (60) which is installed between the rotatable body (40) and the lipstick gripping member (50) and guides to ascend and descend vertically when the lipstick gripping(50) ascends and descends, as a member of which upper and lower portions are opened and an outer periphery is tapered; and a lipstick containing member (70) of which an upper opening is tapered and cut to protect the lipstick (1) therein, as a cylindrical member with opened upper and lower portions fixedly coupled to a tapered outer periphery of the guide member (60), wherein a third cylindrical air vent member (100) is installed as a member installed between the inner periphery of the upper cover (10) and the outer periphery of the lipstick containing member (70) and having a closed upper portion and an opened lower portion, wherein a rod (101) protrudes downwards from the center of the ceiling surface thereof, a circular sphere (102) is formed at an end of the rod (101), and a lower inner peripheral protrusion (103) is formed at a lower inner periphery thereof so as to be in contact with the outer periphery of the lipstick containing member (70), and a lipstick cover member (110) is inserted to the sphere (102) of the third air vent member (100) to cover an upper opening of the lipstick containing member (70).

Advantageous Effects

According to the lipstick case of the present invention, there is an effect of preventing the deterioration of the lipstick by preventing the lipstick from coming into contact with the air as well as preventing external air from flowing into the lipstick case when the lipstick is not used.

BEST MODE

Figure 1:
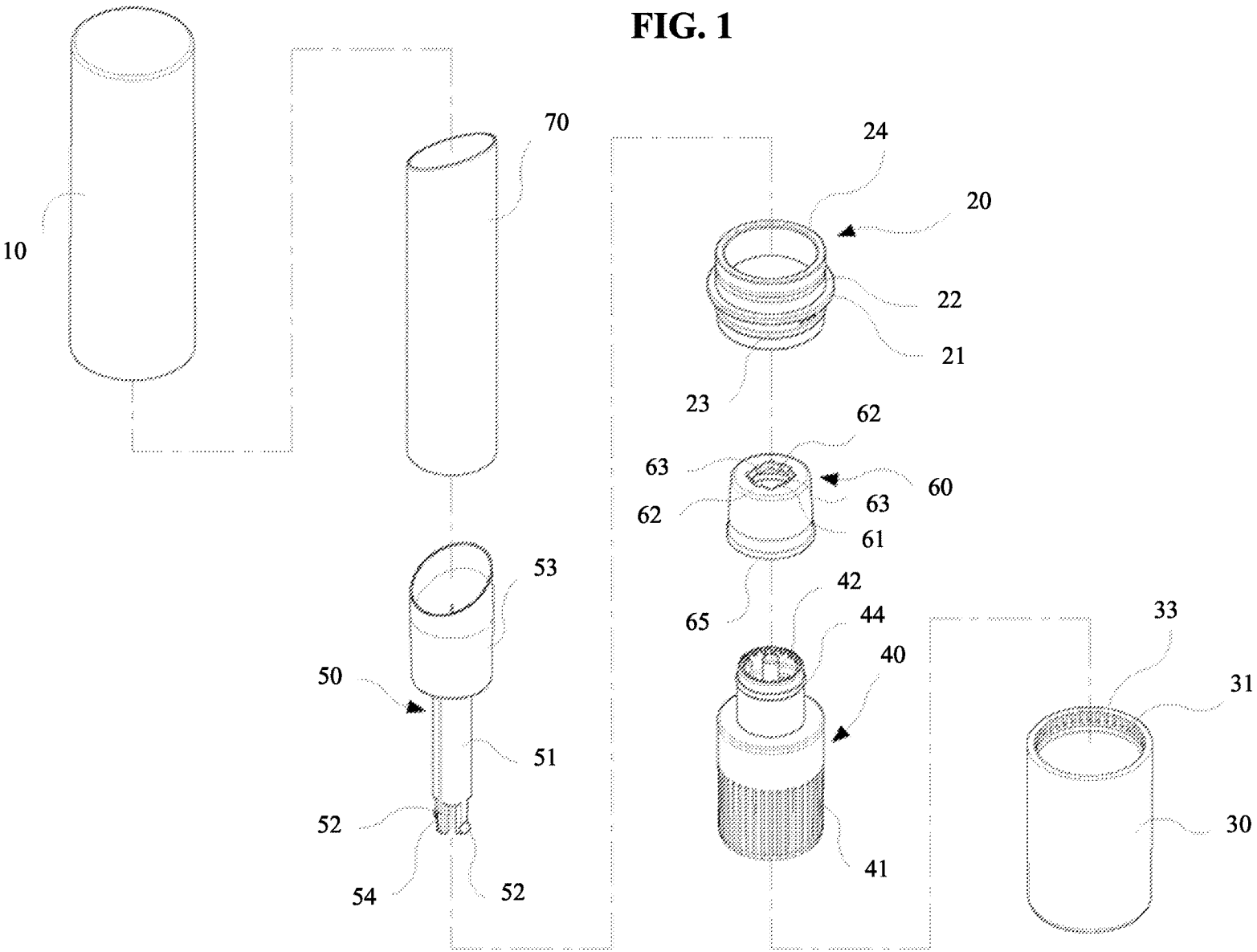
FIG. 1 is an exploded perspective view illustrating a lipstick case according to the present invention.

Hereinafter, a preferred embodiment of the present invention will be described with reference to the accompanying drawings so as to be easily implemented by those skilled in the art. In the accompanying drawings, it should be noted that like reference numerals are used as far as possible when the reference numerals indicated in the configurations indicate like configurations even in different drawings. In the following description of the present invention, a detailed description of known related functions and configurations will be omitted when it is determined when the detailed description may unnecessarily make the gist of the present invention unclear. In addition, some features presented in the drawings are enlarged or reduced or simplified for ease of description, and the drawings and components thereof are not necessarily illustrated at appropriate ratios. However, those skilled in the art will easily understand these details.

Terms including an ordinary number, such as first and second, are used for describing various components, but the components are not limited by the terms. The terms are used only for discriminating one component from the other component. For example, without departing from the scope of the present invention, a first component may be referred to as a second component, and similarly, the second component may be referred to as the first component. A term of 'and/or' includes a combination of a plurality of associated items to be disclosed or any item of the plurality of associated items to be disclosed.

In addition, relative terms described based on those shown in the drawings, such as 'front', 'rear', 'upper', and 'lower', will be replaced with ordinals such as 'first' and 'second'.

For ordinals such as 'first' and 'second', the order thereof is an order to be mentioned above or arbitrarily determined, and the order thereof may be arbitrarily changed as necessary.

Terms used in the present invention are used only to describe specific embodiments, and are not intended to limit the present invention. A singular form may include a plural form unless otherwise clearly indicated in the context. In the present application, it should be understood that the term "comprising" or "having" indicates that a feature, a number, a step, an operation, a component, a part or a combination thereof described in the specification is present, but does not exclude a possibility of presence or addition of one or more other features, numbers, steps, operations, components, parts or combinations, in advance.

Unless defined otherwise, all terms to be used herein including technological or scientific terms have the same meaning as those generally understood by a person with ordinary skill in the art. Terms which are defined in a generally used dictionary should be interpreted to have the same meaning as the meaning in the context of the related art, and are not interpreted as an ideal meaning or excessively formal meanings unless clearly defined in the present application.

Hereinafter, preferable embodiments of the present invention will be described in detail with reference to the accompanying drawings. Further, in describing the present invention, a detailed description for known related configurations or functions will be omitted when it is determined that the detailed description may obscure the gist of the present invention.

First Embodiment

Hereinafter, a preferred embodiment of a lipstick case according to a first embodiment of the present invention will be described in detail with reference to the accompanying drawings.

Figure 2:
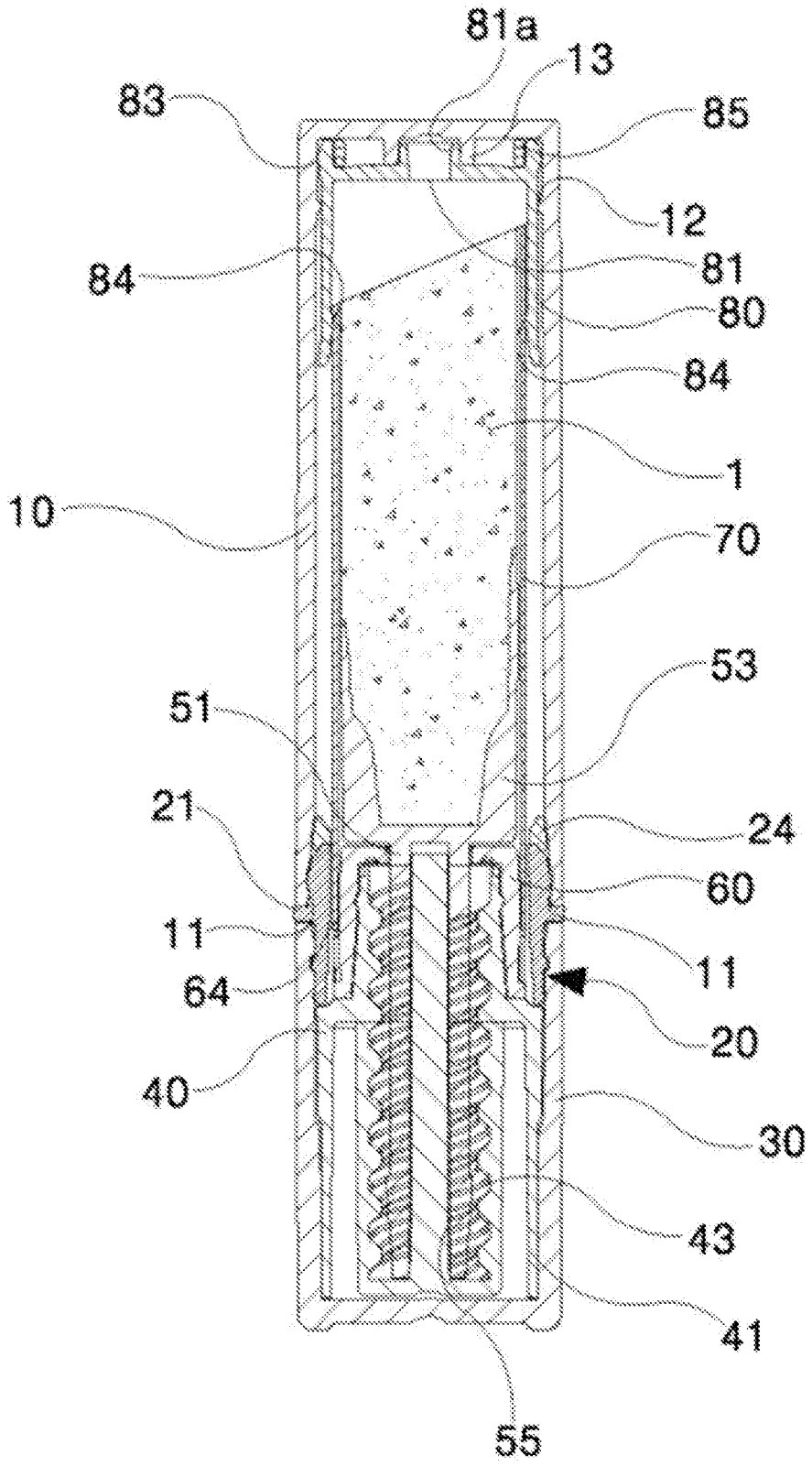
FIG. 2 is an assembly cross-sectional view illustrating a lipstick case according to a first embodiment of the present invention.
Figure 3:
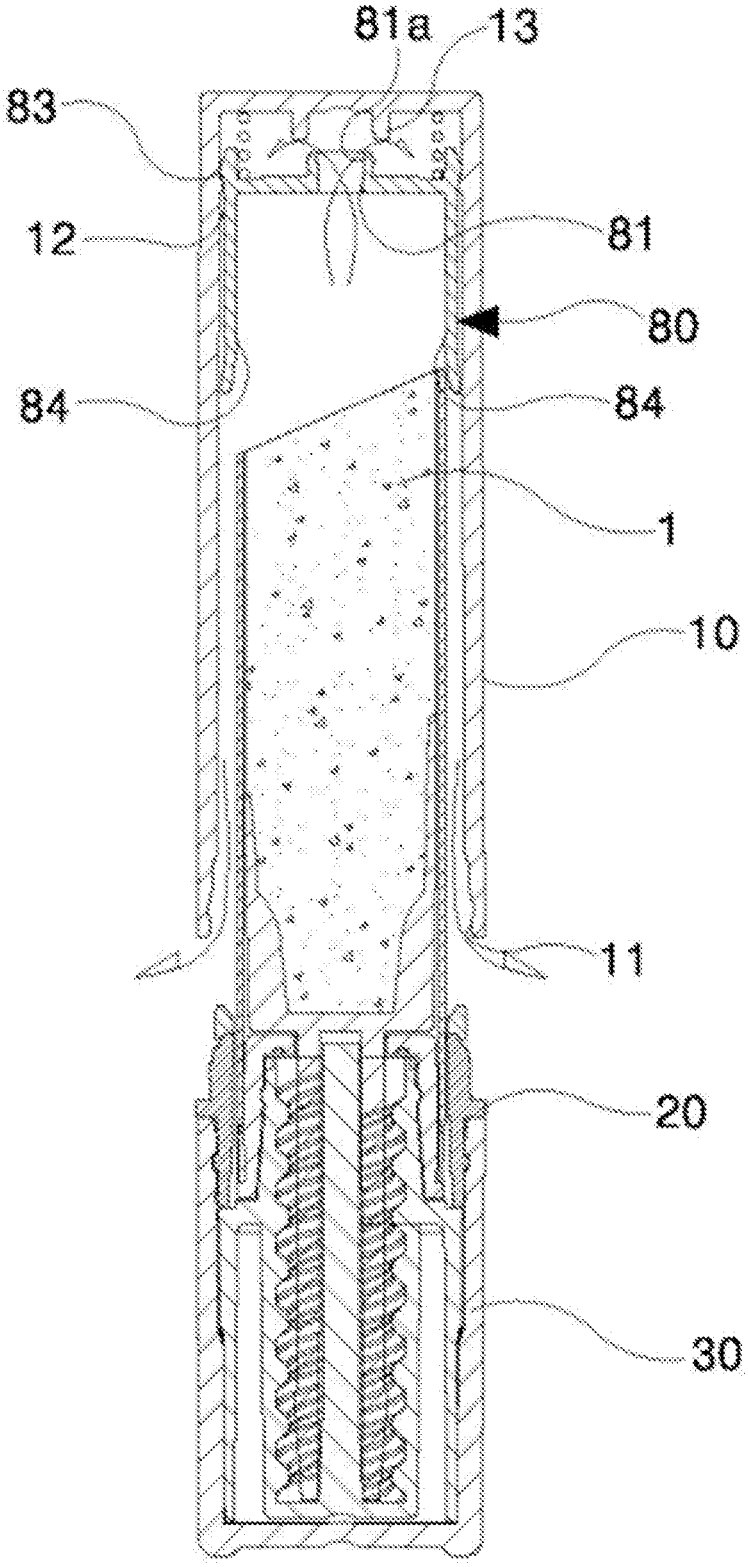
FIG. 3 is a cross-sectional view illustrating when opening an upper cover of the lipstick case according to the first embodiment of the present invention.

FIG. 1 is an exploded perspective view illustrating a lipstick case according to the present invention, FIG. 2 is an assembly cross-sectional view illustrating a lipstick case according to a first embodiment of the present invention, and FIG. 3 is a cross-sectional view illustrating when opening an upper cover of the lipstick case according to the first embodiment of the present invention.

The configuration will be described with reference to FIGS. 1 to 3.

According to a first embodiment of the present invention, a lipstick case comprises: an upper cover 10 having a cylindrical shape in which an upper portion is closed and a lower portion is opened; a shoulder 20 inserted into a lower opening of the upper cover 10, as a cylindrical member with opened upper and lower portions; a lower cover 30 of which an upper opening is inserted and coupled to a lower outer periphery of a cylindrical protrusion 21 protruding outwards from a center of the shoulder 20, as a cylindrical member with an opened upper portion and a closed lower portion; a rotatable body 40 which is a cylindrical member inserted into the lower cover 30 to rotate integrally with the lower cover 30; a lipstick gripping member 50 which is inserted into an inner center of the rotatable body 40 to ascend and descend while rotating integrally with the rotatable body and grips a lipstick 1 on an upper portion thereof; a guide member 60 which is installed between the rotatable body 40 and the lipstick gripping member 50 and guides to ascend and descend vertically when the lipstick gripping member 50 ascends and descends, as a member of which upper and lower portions are opened and an outer periphery is tapered; and a lipstick containing member 70 of which an upper opening is tapered and cut to protect the lipstick 1 therein, as a cylindrical member with opened upper and lower portions fixedly coupled to a tapered outer periphery of the guide member 60.

The shoulder 20 has a cylindrical upper circular groove 22 of which a first circular protrusion 11 protruding from a lower inner periphery of the upper cover 10 in a circumferential direction is inserted to an upper outer periphery based on the cylindrical protrusion 21 protruding from the center, and a cylindrical lower circular groove 23 of which a second circular protrusion 31 protruding from an upper inner periphery of the lower cover 30 in a circumferential direction is inserted to a lower outer periphery of the cylindrical protrusion 21.

At an upper end of the shoulder 20, a strip-shaped packing member 24 that is in contact with an inner peripheral surface of the upper cover 10 to seal the lipstick 1 so as to prevent contamination by external air is provided to cover an upper surface and an outer peripheral surface of the shoulder 20.

The lower cover 30 has a plurality of vertical protrusions 32 formed on a lower inner periphery thereof. The plurality of vertical protrusions 32 are inserted into a plurality of vertical grooves 41 formed in the lower outer periphery of the rotatable body 40 to be rotated according to the rotation of the lower cover 30.

A plurality of vertical guide protrusions 33 are formed even on the upper inner periphery of the lower cover 30 to guide when the rotatable body 40 is inserted.

The rotatable body 40 comprises a central protruding rod 42 which protrudes from a bottom surface in an inner center thereof and has a leg portion 51 of the lipstick gripping member 50 to be seated thereon, and a spiral portion 43 which has a screw formed on an inner peripheral wall spaced apart from the central protruding rod 42 to be spirally coupled to a bolt protrusion 52 of the leg portion 51.

The lipstick gripping member 50 comprises a round cylindrical gripping portion 53 gripping the lipstick 1 vertically thereon, a circular rod-shaped leg portion 51 protruding downwards from the center of a lower end of the gripping portion 53, bolt protrusions 52 protruding from both sides on the lower end of the leg portion 51 to be screw-coupled to the spiral portion 43 of the rotatable body 40, a guide protrusion 54 protruding in a direction perpendicular to the two bolt protrusions 52 to be inserted and guided to the guide member 60, and a plurality of contact protrusions 55 protruding from an inner peripheral wall of the leg portion 51 to which the central protruding rod 42 of the rotatable body 40 is inserted to be in contact with the outer periphery of the central protruding rod 42.

The contact protrusion 55 guides the lipstick gripping member 50 to ascend and descend vertically.

The guide member 60 comprises a quadrangular through hole 61 penetrating through an upper surface thereof to be inserted with the leg portion 51 of the lipstick gripping member 50, a pair of first guide grooves 62 which is formed on a side facing the quadrangular through hole 61 to guide so that the bolt protrusion 52 of the leg portion 51 is inserted, a pair of second guide grooves 63 which is formed on a surface vertical to the first guide grooves 62 to guide so that the guide protrusion 53 of the leg portion 51 is inserted, a cylindrical coupling groove 64 which is formed on an upper side of the inner periphery thereof and inserted and coupled with a coupling protrusion 44 protruding from an upper outer periphery of the rotatable body 40 in a circumferential direction, and a support protrusion 65 which protrudes from the lower end of the outer periphery thereof to support the lower end of the lipstick containing member 70 to be seated.

A first air vent member 80 is installed as a cylindrical member installed between the inner periphery of the upper cover 10 and the outer periphery of the lipstick containing member 70, wherein a lower portion thereof is opened and a center of an upper surface thereof has a vent hole 81.

The first air vent member 80 comprises an upper outer periphery 82 of which an outer periphery protrudes upwards to have a gap between an upper surface thereof and the ceiling surface of the upper cover 10, and a locking step 83 which protrudes from the upper outer periphery 82 to be locked with a second circular protrusion 12 formed on an upper inner periphery of the upper cover 10 at a lower portion thereof, and a lower contact protrusion 84 which protrudes inwards from a lower inner periphery thereof to be in contact with the outer periphery of the lipstick containing member 70.

The vent hole 81 has a cylindrical hole protrusion 81*a* protruding upwards so that the outer periphery of the vent hole 81 is in contact with an inner periphery of a first cylinder 13 protruding downwards from a center of the ceiling surface of the upper cover 10.

A cylindrical spring 85 is installed between the upper surface of the first air vent member 80 and the ceiling surface of the upper cover 10 to act so that the first air vent member 80 descends when the upper cover 10 is opened.

Next, the operation and the effect of the lipstick case configured as described above will be described.

First, when describing an assembling process of the lipstick case, the rotatable body 40 is inserted to the lower cover 30, wherein when the vertical guide protrusion 33 formed on the upper inner periphery of the lower cover 30 descends while being inserted to the plurality of vertical grooves 41 of the rotatable body 40, the plurality of vertical protrusions 32 of the lower cover 30 is inserted and coupled to the vertical grooves 41. In addition, the guide member 60 is coupled to the upper portion of the rotatable body 40, wherein the coupling protrusion 44 of the rotatable body 40 is inserted and coupled to the cylindrical coupling groove 64 formed in the upper inner periphery of the guide member 60.

In such a state, while the bolt protrusion 52 and the guide protrusion 54 formed on the leg portion 51 of the lipstick gripping member 50 are inserted to the first and second guide grooves 62 and 63 of the guide member 60, respectively, the bolt protrusion 52 is located on the spiral portion 43 and then descends up to the lower portion of the rotatable body 40 while rotating as illustrated in FIG. 2.

In addition, the lipstick containing member 70 is seated on the lower support protrusion 65 of the guide member 60 of which the outer periphery has a lower outer diameter tapered larger than an upper outer diameter.

Thereafter, when the shoulder 20 is pushed in downwards through the outer side of the lipstick containing member 70 with the packing member 24 coupled to the upper surface thereof, the second circular protrusion 31 of the lower cover 30 is inserted to the lower circular groove 23 of the shoulder 20 to be rotatably coupled, and the central cylindrical protrusion 21 is seated on the upper surface of the lower cover 30.

In this state, when the upper cover 10 is closed, the first circular protrusion 11 is inserted and coupled into the upper circular groove 22 of the shoulder 20 and the inner peripheral surface of the upper cover 10 is in contact with the packing member 24 to prevent external air from flowing inside.

Further, the lower contact protrusion 84 formed on the lower inner periphery of the first air vent member 80 installed in the upper cover 10 is in contact with the outer periphery of the lipstick containing member 70 to prevent the external air from flowing into the lipstick 1.

In such a lipstick case, when the upper cover 10 is opened and then the lower cover 30 is turned for using, the bolt protrusion 52 of the leg portion 51 engaging with the spiral portion 43 therein ascends along the spiral portion 43 so that the lipstick is used (FIG. 3). When the upper cover 10 is opened, the external air flows into the lipstick case while the lower contact protrusion 84 of the first air vent member 80 releases the contact with the outer periphery of the lipstick containing member 70 and the air flows into δδδδthe vent hole 81 while the first air vent member 80 descends.

As such, when the upper cover 10 is closed when the lipstick in the lipstick case is not used, the lipstick case doubly sealed to prevent the external air from flowing into the lipstick case.

Second Embodiment

Hereinafter, a preferred embodiment of a lipstick case according to a first embodiment of the present invention will be described in detail with reference to the accompanying drawings.

Figure 4:
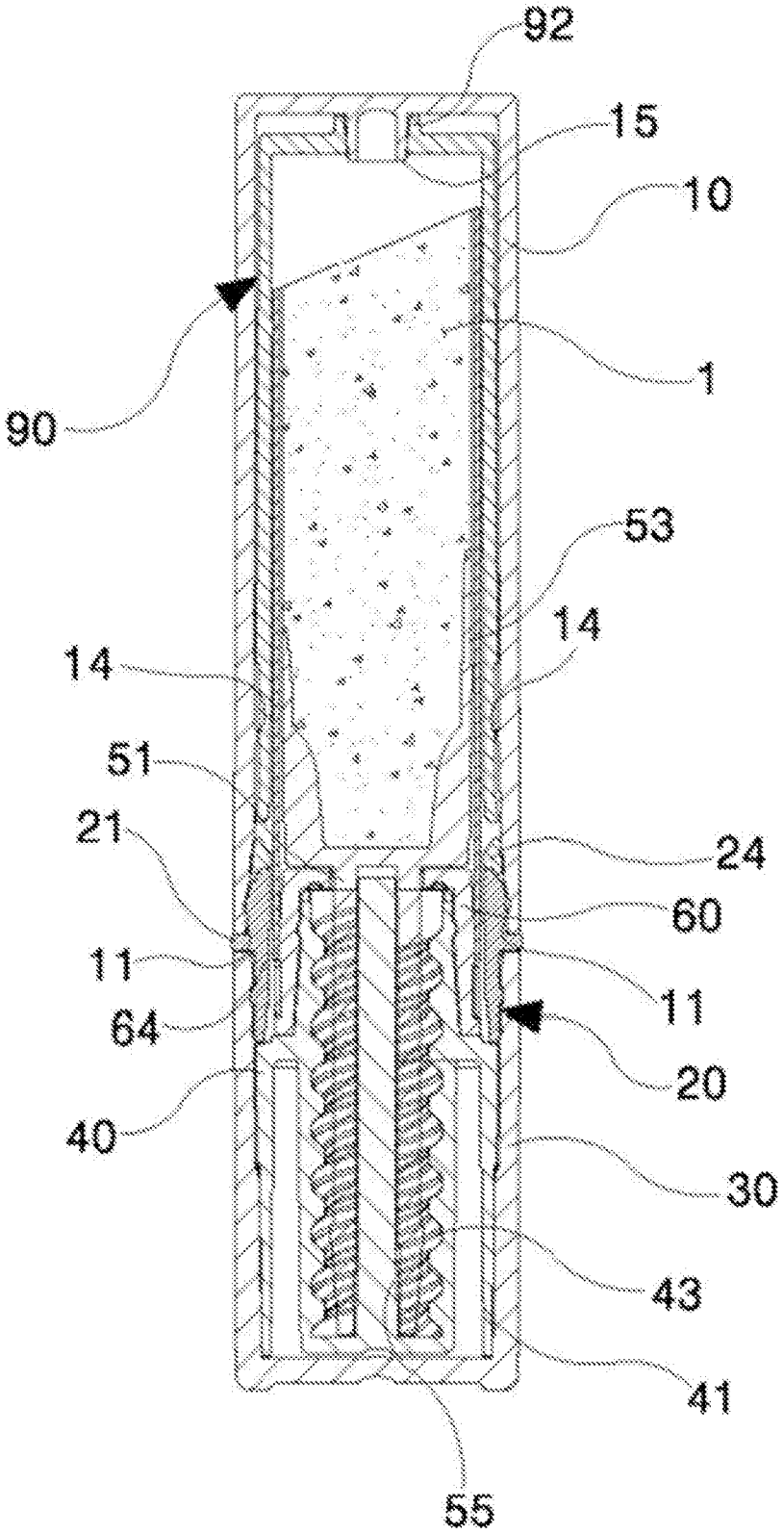
FIG. 4 is an assembly cross-sectional view illustrating a lipstick case according to a second embodiment of the present invention.
Figure 5:
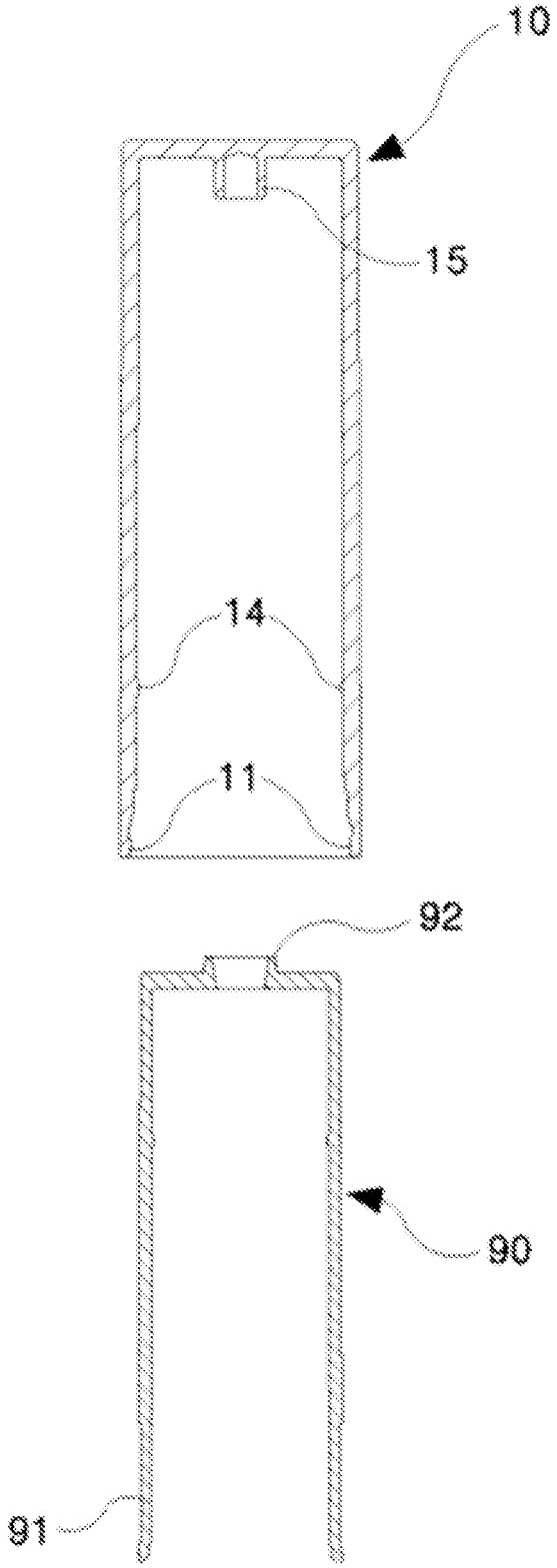
FIG. 5 is an exploded cross-sectional view illustrating an upper cover and an air venter of the lipstick case according to the second embodiment of the present invention.
Figure 6:
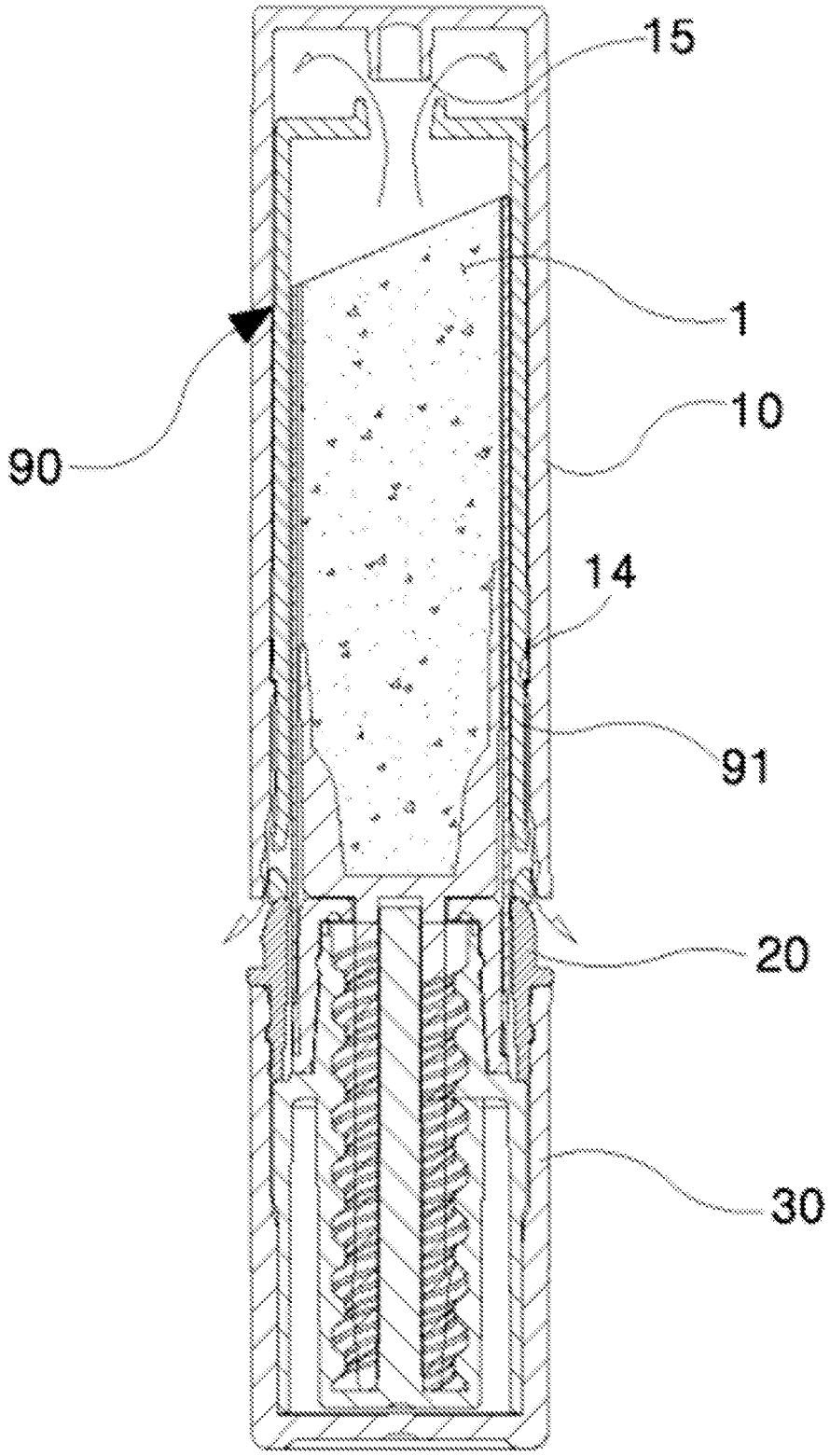
FIG. 6 is a cross-sectional view illustrating when opening an upper cover of the lipstick case according to the second embodiment of the present invention.

FIG. 1 is an exploded perspective view illustrating a lipstick case according to the present invention, FIG. 4 is an assembly cross-sectional view illustrating a lipstick case according to a second embodiment of the present invention, FIG. 5 is an exploded cross-sectional view illustrating an upper cover and an air venter of the lipstick case according to the second embodiment of the present invention, and FIG. 6 is a cross-sectional view illustrating when opening an upper cover of the lipstick case according to the second embodiment of the present invention.

The configuration will be described with reference to FIGS. 1 and 4 to 6.

According to a second embodiment of the present invention, a lipstick case comprises: an upper cover 10 having a cylindrical shape in which an upper portion is closed and a lower portion is opened; a shoulder 20 inserted into a lower opening of the upper cover 10, as a cylindrical member with opened upper and lower portions; a lower cover 30 of which an upper opening is inserted and coupled to a lower outer periphery of a cylindrical protrusion 21 protruding outwards from a center of the shoulder 20, as a cylindrical member with an opened upper portion and a closed lower portion; a rotatable body 40 which is a cylindrical member inserted into the lower cover 30 to rotate integrally with the lower cover 30; a lipstick gripping member 50 which is inserted into an inner center of the rotatable body 40 to ascend and descend while rotating integrally with the rotatable body and grips a lipstick 1 on an upper portion thereof; a guide member 60 which is installed between the rotatable body 40 and the lipstick gripping member 50 and guides to ascend and descend vertically when the lipstick gripping member 50 ascends and descends, as a member of which upper and lower portions are opened and an outer periphery is tapered; and a lipstick containing member 70 of which an upper opening is tapered and cut to protect the lipstick 1 therein, as a cylindrical member with opened upper and lower portions fixedly coupled to a tapered outer periphery of the guide member 60.

The shoulder 20 has a cylindrical upper circular groove 22 of which a first circular protrusion 11 protruding from a lower inner periphery of the upper cover 10 in a circumferential direction is inserted to an upper outer periphery based on the cylindrical protrusion 21 protruding from the center, and a cylindrical lower circular groove 23 of which a second circular protrusion 31 protruding from an upper inner periphery of the lower cover 30 in a circumferential direction is inserted to a lower outer periphery of the cylindrical protrusion 21.

At the upper end of the shoulder 20, a strip-shaped packing member 24 that is in contact with an inner peripheral surface of the upper cover 10 to seal the lipstick 1 so as to prevent contamination by external air is provided to cover an upper surface and an outer peripheral surface of the shoulder 20.

The lower cover 30 has a plurality of vertical protrusions 32 formed on a lower inner periphery thereof. The plurality of vertical protrusions 32 are inserted into a plurality of vertical grooves 41 formed in the lower outer periphery of the rotatable body 40 to be rotated according to the rotation of the lower cover 30.

A plurality of vertical guide protrusions 33 are formed even on the upper inner periphery of the lower cover 30 to guide when the rotatable body 40 is inserted.

The rotatable body 40 comprises a central protruding rod 42 which protrudes from a bottom surface in an inner center thereof and has a leg portion 51 of the lipstick gripping member 50 to be seated thereon, and a spiral portion 43 which has a screw formed on an inner peripheral wall spaced apart from the central protruding rod 42 to be spirally coupled to a bolt protrusion 52 of the leg portion 51.

The lipstick gripping member 50 comprises a round cylindrical gripping portion 53 gripping the lipstick 1 vertically thereon, a circular rod-shaped leg portion 51 protruding downwards from the center of a lower end of the gripping portion 53, bolt protrusions 52 protruding from both sides on the lower end of the leg portion 51 to be screw-coupled to the spiral portion 43 of the rotatable body 40, a guide protrusion 54 protruding in a direction perpendicular to the two bolt protrusions 52 to be inserted and guided to the guide member 60, and a plurality of contact protrusions 55 protruding from an inner peripheral wall of the leg portion 51 to which the central protruding rod 42 of the rotatable body 40 is inserted to be in contact with the outer periphery of the central protruding rod 42.

The contact protrusion 55 guides the lipstick gripping member 50 to ascend and descend vertically.

The guide member 60 comprises a quadrangular through hole 61 penetrating through an upper surface thereof to be inserted with the leg portion 51 of the lipstick gripping member 50, a pair of first guide grooves 62 which is formed on a side facing the quadrangular through hole 61 to guide so that the bolt protrusion 52 of the leg portion 51 is inserted, a pair of second guide grooves 63 which is formed on a surface vertical to the first guide grooves 62 to guide so that the guide protrusion 53 of the leg portion 51 is inserted, a cylindrical coupling groove 64 which is formed on an upper side of the inner periphery thereof and inserted and coupled with a coupling protrusion 44 protruding from an upper outer periphery of the rotatable body 40 in a circumferential direction, and a support protrusion 65 which protrudes from the lower end of the outer periphery thereof to support the lower end of the lipstick containing member 70 to be seated.

A cylindrical second air vent member 90 is installed between the inner periphery of the upper cover 10 and the outer periphery of the lipstick containing member 70 and has an opened lower portion.

The second air vent member 90 comprises a cutting surface 91 of which a lower outer periphery is cut and a third circular protrusion 14 is locked to ascend together when the upper cover 10 is opened at the same time of blocking external air while being in contact with the third circular protrusion 14 protruding in a circular strip shape from the inner periphery of the upper cover 10, and a central hole 92 which is formed at the center of an upper surface thereof and inserted into the outer periphery of the second cylinder 15 protruding downwards from the center of the ceiling surface of the upper cover 10 to block air flowing into the lipstick 1.

Next, the operation and the effect of the lipstick case configured as described above will be described.

First, when describing an assembling process of the lipstick case, the rotatable body 40 is inserted to the lower cover 30, wherein when the vertical guide protrusion 33 formed on the upper inner periphery of the lower cover 30 descends while being inserted to the plurality of vertical grooves 41 of the rotatable body 40, the plurality of vertical protrusions 32 of the lower cover 30 is inserted and coupled to the vertical grooves 41. In addition, the guide member 60 is coupled to the upper portion of the rotatable body 40, wherein the coupling protrusion 44 of the rotatable body 40 is inserted and coupled to the cylindrical coupling groove 64 formed in the upper inner periphery of the guide member 60.

In such a state, while the bolt protrusion 52 and the guide protrusion 54 formed on the leg portion 51 of the lipstick gripping member 50 are inserted to the first and second guide grooves 62 and 63 of the guide member 60, respectively, the bolt protrusion 52 is located on the spiral portion 43 and then descends up to the lower portion of the rotatable body 40 while rotating.

In addition, the lipstick containing member 70 is seated on the lower support protrusion 65 of the guide member 60 of which the outer periphery has a lower outer diameter tapered larger than an upper outer diameter.

Thereafter, when the shoulder 20 is pushed in downwards through the outer side of the lipstick containing member 70 with the packing member 24 coupled to the upper surface thereof, the second circular protrusion 31 of the lower cover 30 is inserted to the lower circular groove 23 of the shoulder 20 to be rotatably coupled, and the central cylindrical protrusion 21 is seated on the upper surface of the lower cover 30.

In this state, when the upper cover 10 is closed, the first circular protrusion 11 is inserted and coupled into the upper circular groove 22 of the shoulder 20 and the inner peripheral surface of the upper cover 10 is in contact with the packing member 24 to prevent external air from flowing inside.

Further, the central hole 92 of the second air vent member 90 installed in the upper cover 10 is closed by the second cylinder 15 protruding from the ceiling surface of the upper cover 10 to prevent the external air from flowing into the lipstick 1.

In such a lipstick case, when the upper cover 10 is opened and then the lower cover 30 is turned for using, the bolt protrusion 52 of the leg portion 51 engaging with the spiral portion 43 therein ascends along the spiral portion 43 so that the lipstick is used (FIG. 6). When the upper cover 10 is opened, the central hole 92 of the second air vent member 90 is opened.

As such, when the upper cover 10 is closed when the lipstick in the lipstick case is not used, the lipstick case is doubly sealed to prevent the external air from flowing into the lipstick case.

Third Embodiment

Hereinafter, a preferred embodiment of a lipstick case according to a first embodiment of the present invention will be described in detail with reference to the accompanying drawings.

Figure 7:
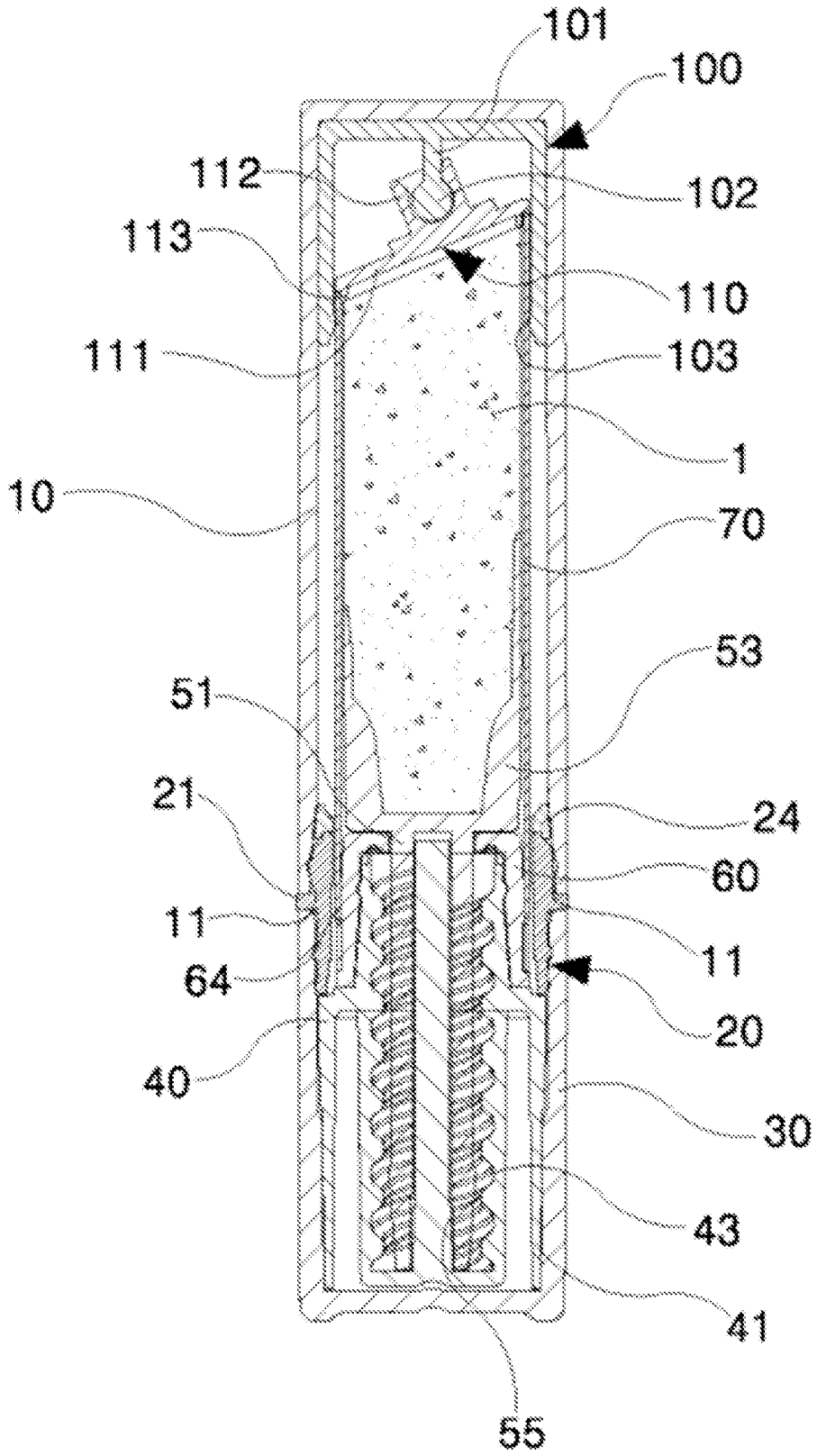
FIG. 7 is an assembly cross-sectional view illustrating a lipstick case according to a third embodiment of the present invention.
Figure 8:
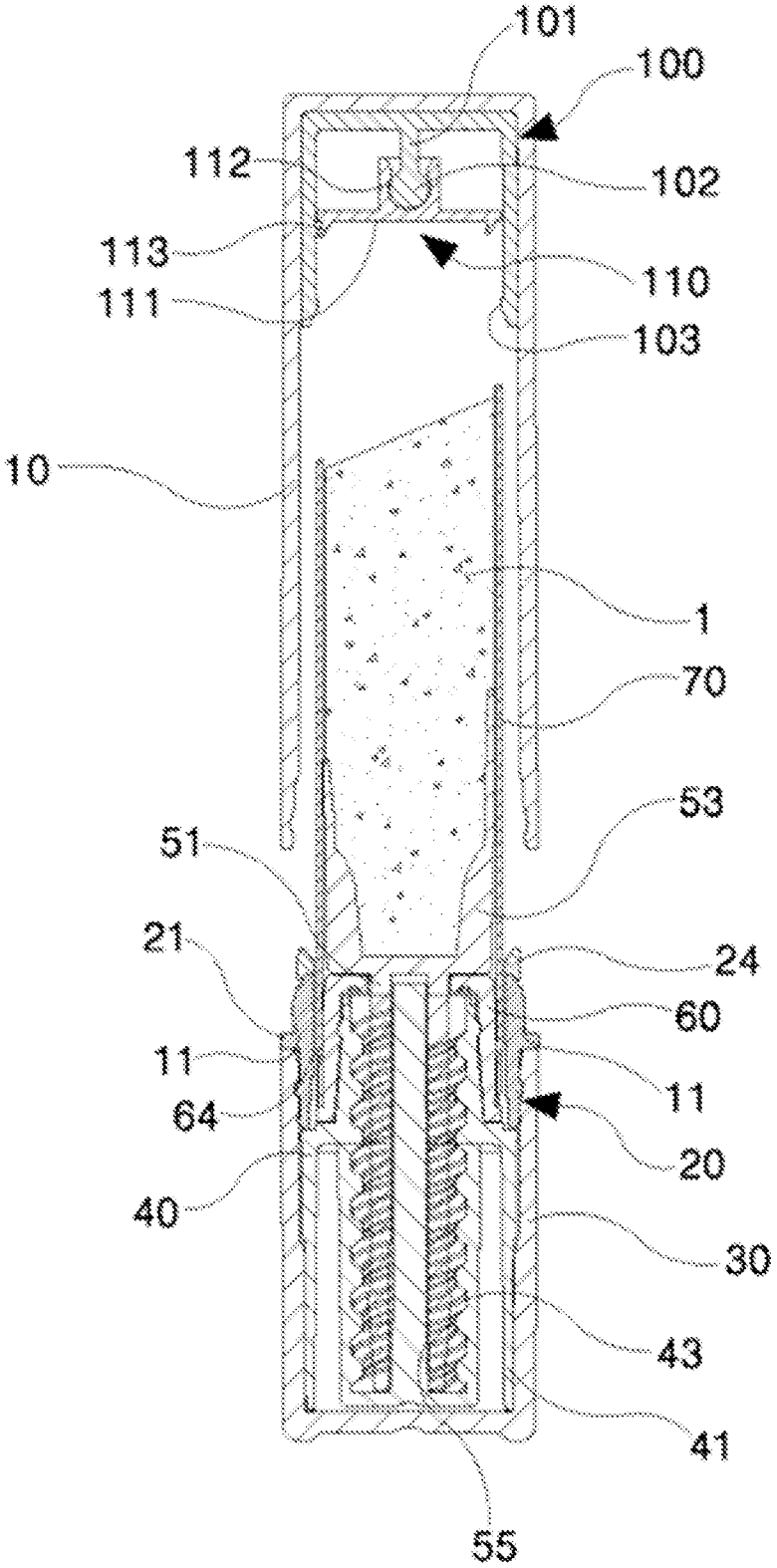
FIG. 8 is a cross-sectional view illustrating when opening an upper cover of the lipstick case according to the third embodiment of the present invention.
Figure 9:
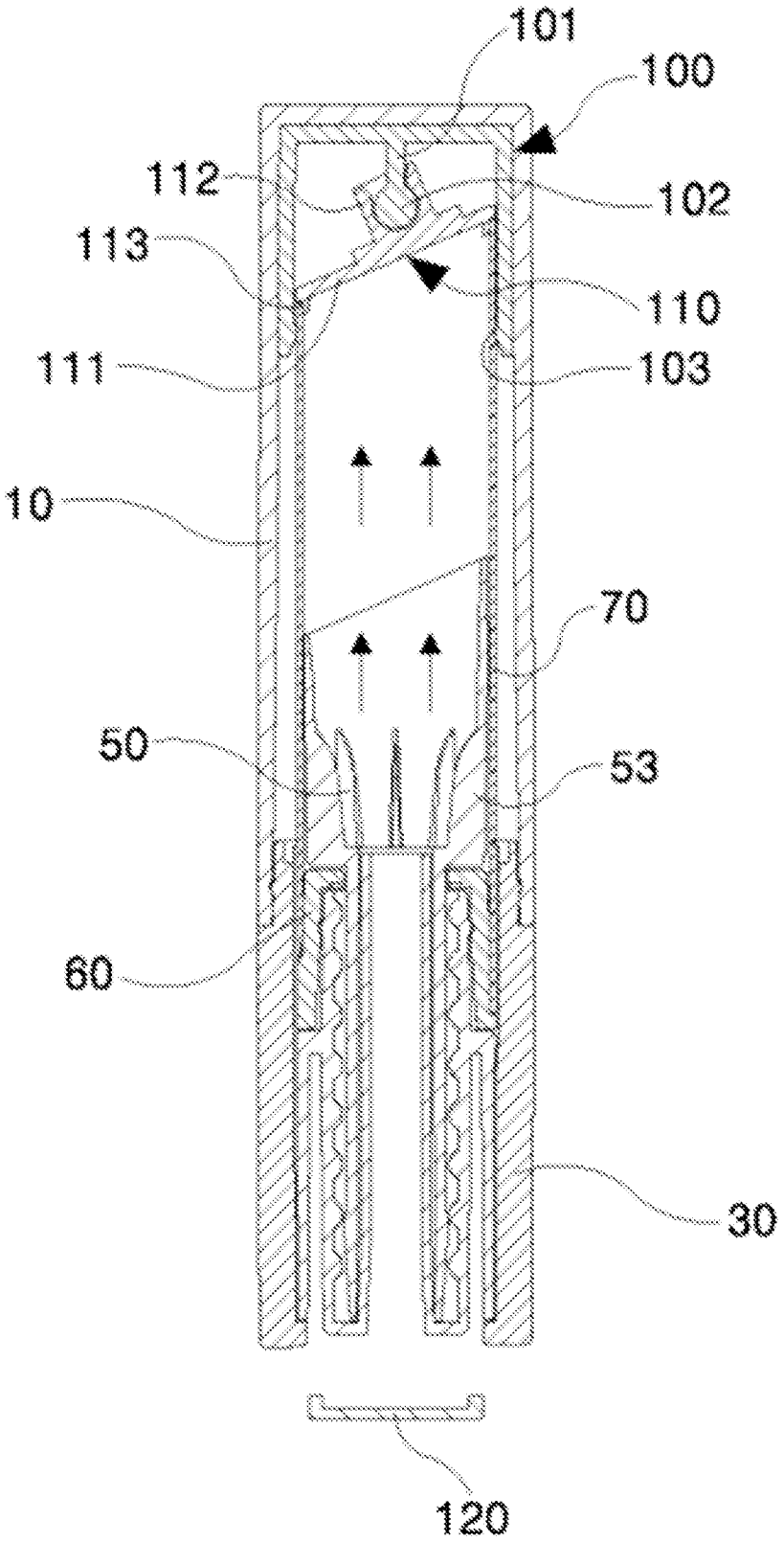
FIG. 9 is a cross-sectional view illustrating when back-filling a cosmetic content of the lipstick case according to the third embodiment of the present invention.

FIG. 1 is an exploded perspective view illustrating a lipstick case according to the present invention, FIG. 7 is an assembly cross-sectional view illustrating a lipstick case according to a third embodiment of the present invention, FIG. 8 is a cross-sectional view illustrating when opening an upper cover of the lipstick case according to the third embodiment of the present invention, and FIG. 9 is a cross-sectional view illustrating when backfilling a cosmetic content of the lipstick case according to the third embodiment of the present invention.

The configuration will be described with reference to FIGS. 1 and 7 to 9.

According to a third embodiment of the present invention, a lipstick case comprises: an upper cover 10 having a cylindrical shape in which an upper portion is closed and a lower portion is opened; a shoulder 20 inserted into a lower opening of the upper cover 10, as a cylindrical member with opened upper and lower portions; a lower cover 30 of which an upper opening is inserted and coupled to a lower outer periphery of a cylindrical protrusion 21 protruding outwards from a center of the shoulder 20, as a cylindrical member with an opened upper portion and a closed lower portion; a rotatable body 40 which is a cylindrical member inserted into the lower cover 30 to rotate integrally with the lower cover 30; a lipstick gripping member 50 which is inserted into an inner center of the rotatable body 40 to ascend and descend while rotating integrally with the rotatable body and grips a lipstick 1 on an upper portion thereof; a guide member 60 which is installed between the rotatable body 40 and the lipstick gripping member 50 and guides to ascend and descend vertically when the lipstick gripping member 50 ascends and descends, as a member of which upper and lower portions are opened and an outer periphery is tapered; and a lipstick containing member 70 of which an upper opening is tapered and cut to protect the lipstick 1 therein, as a cylindrical member with opened upper and lower portions fixedly coupled to a tapered outer periphery of the guide member 60.

The shoulder 20 has a cylindrical upper circular groove 22 of which a first circular protrusion 11 protruding from a lower inner periphery of the upper cover 10 in a circumferential direction is inserted to an upper outer periphery based on the cylindrical protrusion 21 protruding from the center, and a cylindrical lower circular groove 23 of which a second circular protrusion 31 protruding from an upper inner periphery of the lower cover 30 in a circumferential direction is inserted to a lower outer periphery of the cylindrical protrusion 21.

At the upper end of the shoulder 20, a strip-shaped packing member 24 that is in contact with an inner peripheral surface of the upper cover 10 to seal the lipstick 1 so as to prevent contamination by external air is provided to cover an upper surface and an outer peripheral surface of the shoulder 20.

The lower cover 30 has a plurality of vertical protrusions 32 formed on a lower inner periphery thereof. The plurality of vertical protrusions 32 are inserted into a plurality of vertical grooves 41 formed in the lower outer periphery of the rotatable body 40 to be rotated according to the rotation of the lower cover 30.

A plurality of vertical guide protrusions 33 are formed even on the upper inner periphery of the lower cover 30 to guide when the rotatable body 40 is inserted.

The rotatable body 40 comprises a central protruding rod 42 which protrudes from a bottom surface in an inner center thereof and has a leg portion 51 of the lipstick gripping member 50 to be seated thereon, and a spiral portion 43 which has a screw formed on an inner peripheral wall spaced apart from the central protruding rod 42 to be spirally coupled to a bolt protrusion 52 of the leg portion 51.

The lipstick gripping member 50 comprises a round cylindrical gripping portion 53 gripping the lipstick 1 vertically thereon, a circular rod-shaped leg portion 51 protruding downwards from the center of a lower end of the gripping portion 53, bolt protrusions 52 protruding from both sides on the lower end of the leg portion 51 to be screw-coupled to the spiral portion 43 of the rotatable body 40, a guide protrusion 54 protruding in a direction perpendicular to the two bolt protrusions 52 to be inserted and guided to the guide member 60, and a plurality of contact protrusions 55 protruding from an inner peripheral wall of the leg portion 51 to which the central protruding rod 42 of the rotatable body 40 is inserted to be in contact with the outer periphery of the central protruding rod 42.

The contact protrusion 55 guides the lipstick gripping member 50 to ascend and descend vertically.

The guide member 60 comprises a quadrangular through hole 61 penetrating through an upper surface thereof to be inserted with the leg portion 51 of the lipstick gripping member 50, a pair of first guide grooves 62 which is formed on a side facing the quadrangular through hole 61 to guide so that the bolt protrusion 52 of the leg portion 51 is inserted, a pair of second guide grooves 63 which is formed on a surface vertical to the first guide grooves 62 to guide so that the guide protrusion 53 of the leg portion 51 is inserted, a cylindrical coupling groove 64 which is formed on an upper side of the inner periphery thereof and inserted and coupled with a coupling protrusion 44 protruding from an upper outer periphery of the rotatable body 40 in a circumferential direction, and a support protrusion 65 which protrudes from the lower end of the outer periphery thereof to support the lower end of the lipstick containing member 70 to be seated.

A third air vent member 10 is installed between the inner periphery of the upper cover 10 and the outer periphery of the lipstick containingmember 70 and has a cylindrical shape with a closed upper portion and an opened lower portion, and the third air vent member 10 is installed closely in the upper cover 10.

In the third air vent member 10, a rod 101 protrudes downwards from the center of the ceiling surface thereof, a circular sphere 102 is formed at an end of the rod 101, and a lower inner peripheral protrusion 103 is formed at a lower inner periphery thereof so as to be in contact with the outer periphery of the lipstick containingmember 70.

In addition, a lipstick cover member 110 is inserted to the sphere 102 of the third air vent member 100 to cover an upper surface opening of the lipstick containingmember 70.

The lipstick cover member 110 comprises a circular plate-shaped portion 111, a sphere insertion coupling portion formed at a center of an upper surface of the circular plate-shaped portion 111 so that the sphere of the third air vent member is inserted and coupled, and a vertical contact portion protruding vertically toward an outer lower end of the circular plate-shaped portion 111 to be in contact with an inner periphery of the upper opening of the lipstick containingmember 70.

Since the lipstick cover member 110 has a structure in which the sphere 102 is inserted and coupled to the sphere insertion coupling portion 112, the lipstick cover member 110 is installed to be inclined in all directions. That is, even if the upper opening of the lipstick containingmember 70 is inclined in any direction, it is possible to cover the lipstick containingmember 70.

The lipstick cover member 110 covers the upper opening of the lipstick containingmember 70, so that the lipstick 1 is used even when filled from the bottom (see FIG. 9).

Reference numeral 120, which is not described, is a backfilling cover that closes the lower portion of the lipstick case.

Next, the operation and the effect of the lipstick case configured as described above will be described.

First, when describing an assembling process of the lipstick case, the rotatable body 40 is inserted to the lower cover 30, wherein when the vertical guide protrusion 33 formed on the upper inner periphery of the lower cover 30 descends while being inserted to the plurality of vertical grooves 41 of the rotatable body 40, the plurality of vertical protrusions 32 of the lower cover 30 is inserted and coupled to the vertical grooves 41. In addition, the guide member 60 is coupled to the upper portion of the rotatable body 40, wherein the coupling protrusion 44 of the rotatable body 40 is inserted and coupled to the cylindrical coupling groove 64 formed in the upper inner periphery of the guide member 60.

In such a state, while the bolt protrusion 52 and the guide protrusion 54 formed on the leg portion 51 of the lipstick gripping member 50 are inserted to the first and second guide grooves 62 and 63 of the guide member 60, respectively, the bolt protrusion 52 is located on the spiral portion 43 and then descends up to the lower portion of the rotatable body 40 while rotating.

In addition, the lipstick containingmember 70 is seated on the lower support protrusion 65 of the guide member 60 of which the outer periphery has a lower outer diameter tapered larger than an upper outer diameter.

Thereafter, when the shoulder 20 is pushed in downwards through the outer side of the lipstick containingmember 70 with the packing member 24 coupled to the upper surface thereof, the second circular protrusion 31 of the lower cover 30 is inserted to the lower circular groove 23 of the shoulder 20 to be rotatably coupled, and the central cylindrical protrusion 21 is seated on the upper surface of the lower cover 30.

In this state, when the upper cover 10 is closed, the first circular protrusion 11 is inserted and coupled into the upper circular groove 22 of the shoulder 20 and the inner peripheral surface of the upper cover 10 is in contact with the packing member 24 to prevent external air from flowing inside.

Further, the lipstick cover member 110 inserted to the sphere 102 of the third air vent member 100 installed in the upper cover 10 covers the upper opening of the lipstick containingmember 70 to prevent the external air from flowing into the lipstick 1.

In such a lipstick case, when the upper cover 10 is opened and then the lower cover 30 is turned for using, the bolt protrusion 52 of the leg portion 51 engaging with the spiral portion 43 therein ascends along the spiral portion 43 so that the lipstick is used (FIG. 6). When the upper cover 10 is opened, the lipstick cover member 110 opens the upper opening of the lipstick containing member 70 while the third air vent member 100 ascends together.

As such, when the upper cover 10 is closed when the lipstick in the lipstick case is not used, the lipstick cover member 110 closes the upper opening of the lipstick containingmember 70 to prevent the external air from flowing into the lipstick.

As described above, the detailed embodiments have been described in the detailed description of the present invention, but it will be apparent that there is a possibility that the technology of the present invention will be easily modified and implemented by those skilled in the art and these modified embodiments will be included in the technical spirit disclosed in the appended claims of the present invention.

Explanation of Reference Numerals and Symbols

| | |
|---|---|
| 10: Upper cover | 11: First circular protrusion |
| 12: Second circular protrusion | 13: First cylinder |
| 14: Third circular protrusion | 15: Second cylinder |
| 70: Lipstick containingmember | 80: First air vent member |
| 81: Vent hole | 81a: Hole protrusion |
| 82: Upper outer periphery | 83: Locking step |

-continued

| | |
|---|---|
| 84: Lower contact protrusion | 90: Second air vent member |
| 91: Cutting surface | 92: Central hole |
| 100: Third air vent member | 101: Rod |
| 102: Sphere | 103: Lower inner peripheral protrusion |
| 110: Lipstick cover member | 111: Circular plate-shaped portion |
| 112: Sphere insertion coupling portion | 113: Vertical contact portion |
| 120: Backfilling cover | |

The invention claimed is:

1. A lipstick case comprising:

an upper cover having a cylindrical shape in which an upper portion is closed and a lower portion is opened;

a shoulder, having a cylindrical shape and opened upper and lower portions, and inserted into a lower opening of the upper cover;

a lower cover having a cylindrical shape and including an opened upper portion and a closed lower portion, wherein a lower outer periphery of a cylindrical protrusion protruding outwards from a center of the shoulder is inserted and coupled to the opened upper portion of the lower cover;

a rotatable body having a cylindrical shape, inserted into the lower cover to rotate integrally with the lower cover;

a lipstick gripping member which is inserted into an inner center of the rotatable body to ascend and descend while rotating integrally with the rotatable body and grips a lipstick on an upper portion thereof;

a guide member which is installed between the rotatable body and the lipstick gripping member and guides to ascend and descend vertically when the lipstick gripping member ascends and descends, wherein upper and lower portions of the guide member are opened and an outer periphery thereof is tapered; and a lipstick containing member including an upper opening tapered and cut to protect the lipstick therein, and having a cylindrical shape and opened upper and lower portions fixedly coupled to a tapered outer periphery of the guide member, wherein a first air vent member of which a lower portion is opened and a center of an upper surface has a vent hole is installed as a cylindrical member installed between an inner periphery of the upper cover and an outer periphery of the lipstick containing member.

2. The lipstick case of claim 1, wherein the first air vent member comprises an upper outer periphery of which an outer periphery protrudes upwards to have a gap between an upper surface thereof and a ceiling surface of the upper cover;

a locking step which protrudes from the upper outer periphery to be locked with a second circular protrusion formed on an upper inner periphery of the upper cover at a lower portion thereof; and a lower contact protrusion which protrudes inwards from a lower inner periphery thereof to be in contact with the outer periphery of the lipstick containing member, wherein the vent hole has a cylindrical hole protrusion protruding upwards so that an outer periphery of the vent hole is in contact with an inner periphery of a first cylinder protruding downwards from a center of the ceiling surface of the upper cover.

3. The lipstick case of claim 1, wherein a cylindrical spring is installed between the upper surface of the first air vent member and a ceiling surface of the upper cover to act so that the first air vent member descends when the upper cover is opened.

* * * * *